US008011476B1

(12) United States Patent
Alcon

(10) Patent No.: US 8,011,476 B1
(45) Date of Patent: Sep. 6, 2011

(54) LADDER ATTACHMENT

(76) Inventor: C. Jerry Alcon, Gibsonville, NC (US)

( * ) Notice: Subject to any disclaimer, the term of this patent is extended or adjusted under 35 U.S.C. 154(b) by 327 days.

(21) Appl. No.: 12/399,385

(22) Filed: Mar. 6, 2009

(51) Int. Cl.
*E06C 1/36* (2006.01)
*E06C 7/16* (2006.01)

(52) U.S. Cl. ..... 182/206; 182/116

(58) Field of Classification Search ..... 182/206, 182/116
See application file for complete search history.

(56) References Cited

U.S. PATENT DOCUMENTS

| | | | | | |
|---|---|---|---|---|---|
| 1,522,292 | A | * | 1/1925 | Enssle | 182/107 |
| 2,232,414 | A | * | 2/1941 | Swann | 182/206 |
| 2,775,489 | A | * | 12/1956 | Hagadorn | 182/129 |
| 2,778,556 | A | * | 1/1957 | Johnson | 182/206 |
| 3,028,929 | A | * | 4/1962 | Chubbs | 182/206 |
| 3,336,999 | A | * | 8/1967 | McSwain | 182/20 |
| 4,018,301 | A | * | 4/1977 | Nameche | 182/206 |
| 4,318,454 | A | * | 3/1982 | Johnson | 182/129 |
| 4,469,195 | A | * | 9/1984 | Sartain | 182/206 |
| 4,946,004 | A | * | 8/1990 | Henson | 182/206 |
| 4,995,476 | A | * | 2/1991 | Buck | 182/206 |
| 4,995,578 | A | * | 2/1991 | Monheim | 248/210 |
| 5,388,664 | A | * | 2/1995 | Bator | 182/100 |
| 5,460,240 | A | * | 10/1995 | Jones | 182/116 |
| 5,538,101 | A | * | 7/1996 | Kempf | 182/116 |
| 5,590,738 | A | * | 1/1997 | Hunt et al. | 182/116 |
| 5,638,916 | A | * | 6/1997 | Schneider | 182/206 |
| 7,134,525 | B1 | * | 11/2006 | Ferris | 182/107 |
| 7,886,872 | B2 | * | 2/2011 | Astor et al. | 182/129 |
| 2006/0021824 | A1 | * | 2/2006 | White et al. | 182/129 |
| 2010/0018803 | A1 | * | 1/2010 | Schwenke et al. | 182/206 |

FOREIGN PATENT DOCUMENTS

| | | | |
|---|---|---|---|
| EP | 232206 | A2 * | 8/1987 |
| GB | 2459118 | A * | 10/2009 |

* cited by examiner

*Primary Examiner* — Alvin C Chin-Shue
*Assistant Examiner* — Jaime F Cárdenas-García

(57) ABSTRACT

A ladder attachment for use on ladder tree stands, conventional ladders and otherwise to temporarily secure the top of the ladder to a tree or post. The ladder attachment includes a pair of pivotable jaws which can be closed around a tree and locked in place while standing on the ground. The ladder is temporarily secured so the user can climb the ladder and attach a more permanent, standard anchor belt. The method includes steps for affixing the ladder attachment to a ladder, positioning the ladder and ladder attachment against a tree, securing the ladder attachment to the tree and thereafter removing the ladder attachment and later the ladder for further use.

10 Claims, 7 Drawing Sheets

LADDER ATTACHMENT

FIELD OF THE INVENTION

The invention herein pertains to standard ladder tree stands, ladders and the like and particularly pertains to a ladder attachment for temporarily attaching the top of a raised ladder to a tree or post.

DESCRIPTION OF THE PRIOR ART AND OBJECTIVES OF THE INVENTION

The use of various ladders can be dangerous as oftentimes the user will position the top of the ladder against a tree, post or other structure in a hazardous or unstable manner. While the foot of the ladder is easily observed and its stability assured, the top of the ladder creates a different problem as it is often obscured from the user's view due to its distance, or leaves, limbs and otherwise which may prevent it from being completely seen. This is especially true for hunters that often use ladder tree stands with leaves and limbs blocking, partially or fully obscuring the top. Thus when the ladder is believed to be secured, a hunter will begin to climb to the top only to find the ladder improperly positioned, causing it to slip or fall and possibly injuring the user.

To remedy this problem the present invention was conceived and one of its objectives is to provide a ladder attachment to insure the user's safety and to prevent injuries.

It is another objective of the present invention to provide a ladder attachment which can be quickly attached and removed from the top of a ladder as required.

It is still another objective of the present invention to provide a ladder attachment which includes a pair of pivotable jaws which will engage a tree, post or other structure for temporary securement thereto.

It is yet another objective of the present invention to provide a ladder attachment which is relatively inexpensive to manufacture and sell.

It is still a further objective of the present invention to provide a ladder attachment which can be easily installed and removed as desired.

It is yet a further objective of the present invention to provide a ladder attachment which can be operated from the ground to secure or release the top of a ladder.

Various other objectives and advantages of the present invention will become apparent to those skilled in the art as a more detailed description is set forth below.

SUMMARY OF THE INVENTION

The aforesaid and other objectives are realized by providing a ladder attachment which can be quickly affixed and removed from a ladder tree stand or other standard ladder. The ladder attachment includes a pair of spring-biased pivotable jaws rotatably joined to a base. Each jaw is formed with an arcuate arm having a circular gear at one end comprising a plurality of teeth. A pair of pawls is also attached to the base for engagement with the gear teeth. Each pawl includes a pawl finger and a leader attached thereto which is joined to a pull cord. The pull cord is lengthy and extends from the top of the ladder to the ground. As needed, additional cord may be added to make the pull cord longer depending on the length of the ladder the ladder attachment will be used with. The jaws of the ladder attachment are arcuate and normally in an inward closed configuration but can be manually pivoted outwardly to allow a hasp connected to each pawl to engage a vertical post positioned on each of the jaws to lock the jaws in an open configuration. The planar base of the ladder attachment includes a plurality of U-bolt apertures for receiving U-bolts which are used to affix the ladder attachment to, for example a ladder tree stand. Once the ladder attachment is affixed and the jaws positioned in an open configuration, the ladder tree stand can be raised as usual for positioning against a tree, post or the like. A cord joined to the ladder attachment can be operated while standing on the ground. The user simply pulls the cord, thus releasing the hasps from the posts and allowing the open jaws to close and grip the tree. As the jaws close the pawl fingers engage teeth on the jaws to maintain and lock the jaws in a closed configuration around the tree to temporarily secure the top of the ladder to the tree. Once the tree is so gripped, the user can then climb the tree stand ladder or the like and affix a standard nylon anchor belt to insure the tree stand ladder remains securely, properly positioned. Thereafter the ladder attachment can be removed by removing the U-bolts and either pulling the pawls or by pulling the cord the pawl fingers are released from the teeth of the jaws allowing the jaws to open and the ladder attachment to be slid from the tree. The jaws will pivot inwardly to a closed configuration and the user can then simply use the cord to lower the ladder attachment to the ground where it can then be stored until it is desired to move the tree stand ladder which may be a few days, weeks or months.

Should it be desired to move the tree stand ladder from its present position, the ladder attachment can again be affixed to the top of the tree stand ladder by U-bolts and with the jaws engaging the tree the user can remove the anchor belt and descend the ladder. While on the ground the user pulls the cord to release the pawl fingers from the gear teeth which allows the jaws to freely pivot and slide from around the tree while the ladder is pivoted from the tree. The ladder with the ladder attachment affixed thereto can then be installed and secured on another tree and the ladder attachment removed as hereinbefore described for storage purposes.

DETAILED DESCRIPTION OF THE PREFERRED EMBODIMENT AND OPERATION OF THE INVENTION

Figure 1:
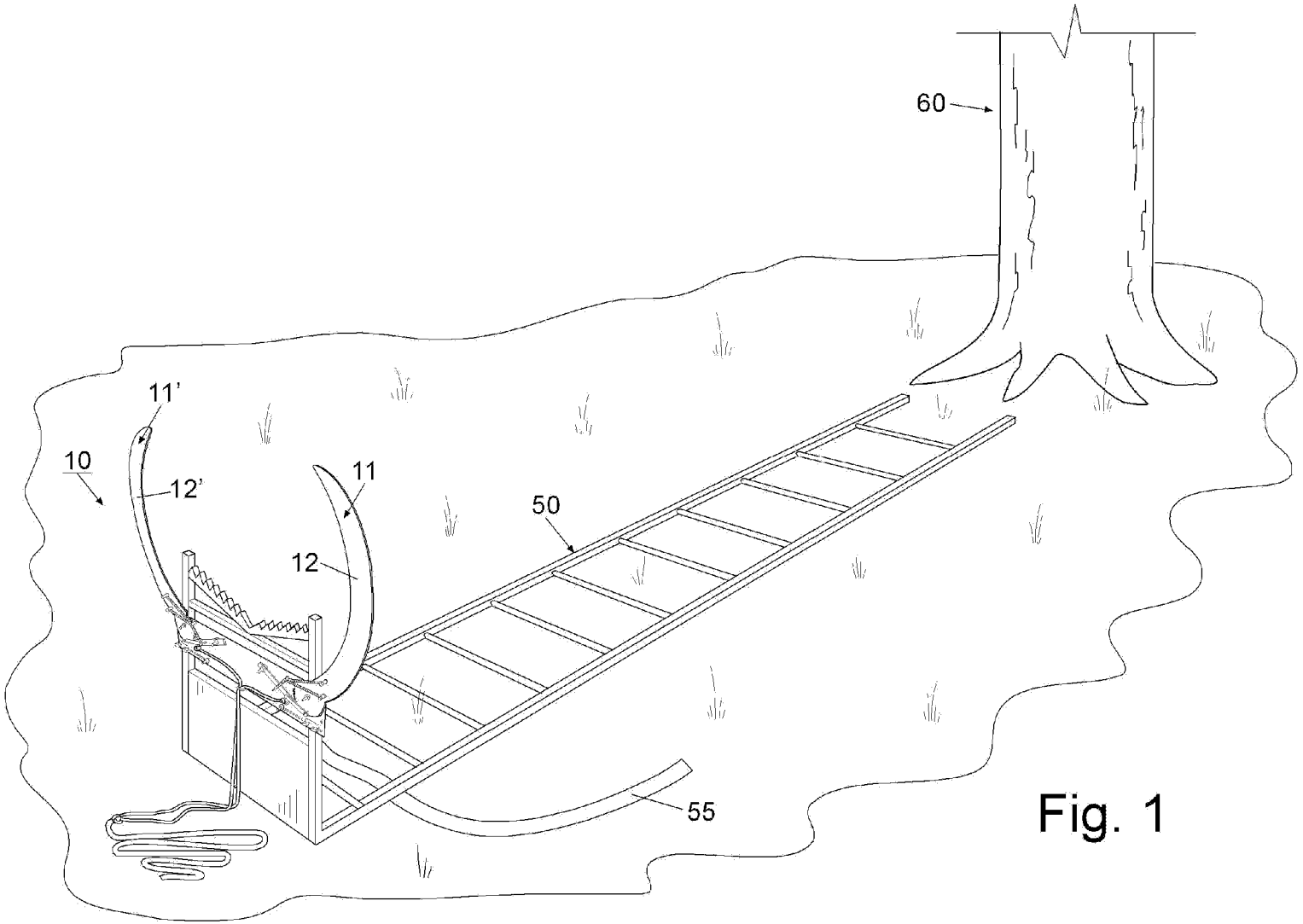
FIG. 1 schematically illustrates the preferred ladder attachment affixed to a ladder tree stand with the pivotable jaws in an open configuration prior to positioning against a tree.

For a better understanding of the invention and its operation, turning now to the drawings, FIG. 1 shows in schematic representation a typical hunter's metal ladder tree stand 50 on the ground with preferred ladder attachment 10 affixed thereto. Ladder tree stand 50 is shown at the base of tree 60 prior to raising and attaching to tree 60 such as before hunting, photography or other purposes. As would be understood, ladder attachment 10 is shown on a standard ladder tree stand but could likewise be adapted for use on various types of ladders and the like as necessary when a temporary attachment to a tree, pole or other support is desired.

Figure 9:
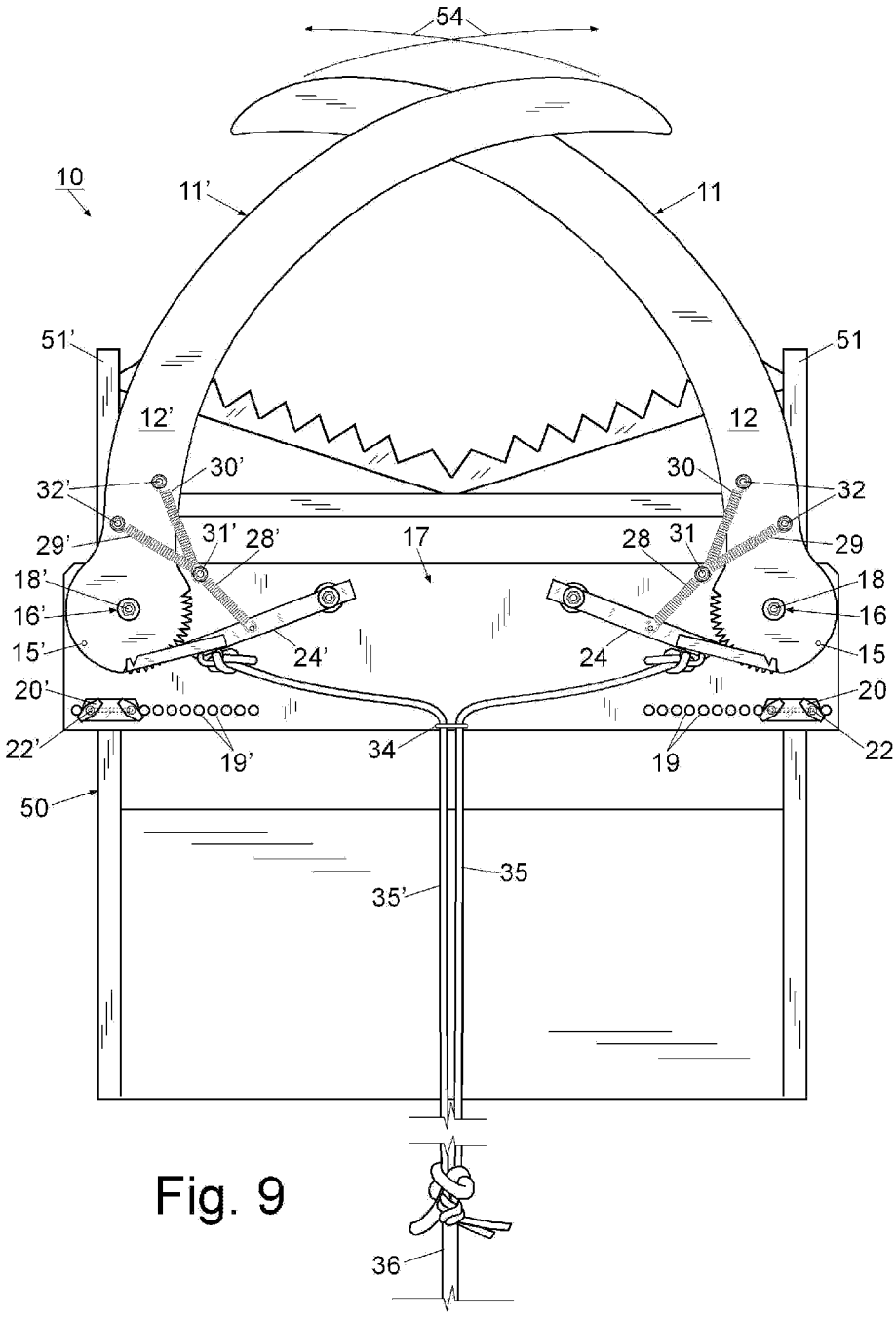
FIG. 9 pictures a top view of the ladder attachment as affixed to the ladder tree stand in a closed configuration.

Preferred ladder attachment 10 as seen throughout FIGS. 1-12 includes base 17 and a pair of pivotable jaws 11, 11'. Jaws 11, 11' each include respectively arcuate arms 12, 12', circular gears 13, 13' with respectively teeth 14, 14' and posts 15, 15'. Jaws 11, 11' are each rotatably affixed to base 17 by conventional nuts and bolts 18, 18'. Ladder attachment 10 further includes rotatable pawls 24, 24' having respectively pawl fingers 23, 23' and affixed respectively to hasps 25, 25' which respectively include V-shaped terminal notches 26, 26'. Pawls 24, 24' are also rotatably affixed to base 17 by conventional nuts and bolts. Spring retainers 31, 31' maintain respectively, springs 28, 29, 30 and springs 28', 29', 30' on base 17 as shown in FIG. 9. Spring retainers 32, 32' maintain respectively, springs 29, 30 and springs 29', 30' respectively on jaws 11, 11' also shown in FIG. 9. Retainers 31, 31', 32, 32' consist of threaded members with nuts which pass through apertures 33, 33' (33' not seen) in respectively jaws 11, 11' (FIGS. 3 and 4) The opposite ends of springs 28, 28' are respectively maintained on pawls 24, 24' while the opposite ends of springs 29, 30 and springs 29', 30' are respectively affixed to arms 12, 12' by conventional nuts and bolts 32, 32'. Leaders 35, 35' are each respectively attached to pawls 24, 24' on one end and both are connected to cord 36 at the opposite end. Cord 36 is a standard braided nylon rope of suitable length but other types of ropes, cords or cables may be used. As would be understood the length of cord 36 is somewhat dependent on the length of the ladder being utilized. Base 17 includes a plurality of apertures 19, 19' for respective placement of U-bolts 22, 22' for affixing ladder attachment 10 to a ladder. Metal staple 34 is centrally positioned on base 17 for receiving leaders 35, 35' allowing for smooth, simultaneous movement of jaws 11, 11' as needed.

Figure 3:
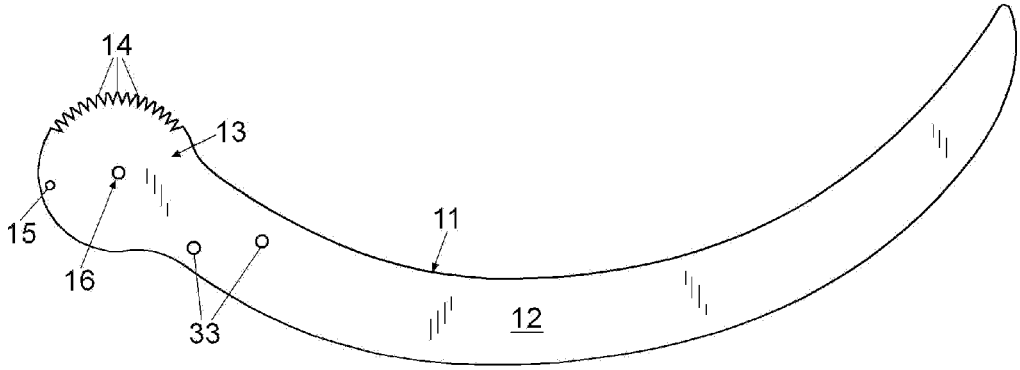
FIG. 3 shows an enlarged top view of one of the pivotable jaws as removed from the ladder attachment seen in FIG. 1.
Figure 4:
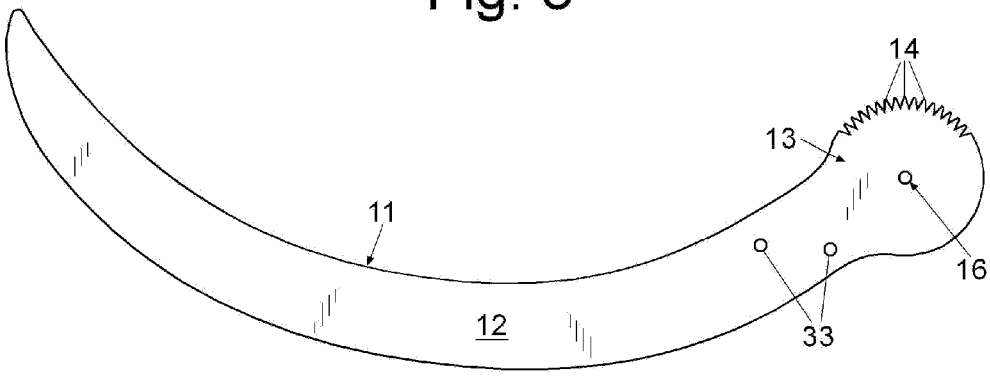
FIG. 4 pictures a bottom view of the pivotable jaw seen in FIG. 3.
Figure 5:
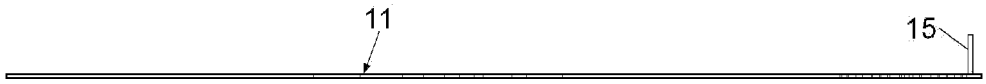
FIG. 5 depicts a left side view of the pivotable jaw seen in FIG. 3.
Figure 6:
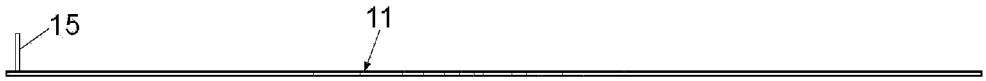
FIG. 6 demonstrates a right side view of the pivotable jaw seen in FIG. 3.
Figure 7:
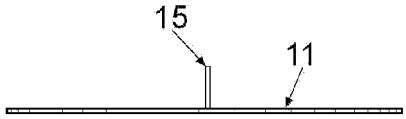
FIG. 7 illustrates a front view of the pivotable jaw seen in FIG. 3.
Figure 8:
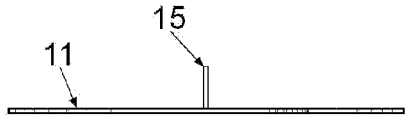
FIG. 8 features a rear view of the pivotable jaw seen in FIG. 3.

In FIGS. 3-8, various views are shown of jaw 11 as removed from ladder attachment 10, it being understood that jaw 11' is a mirror image thereof. As shown in FIG. 3, gear 13 includes a plurality of teeth 14 and post 15 is vertically mounted on gear 13 as explained in more detail below. Channels 16, 16' (FIG. 9) allow respectively axle bolts 18, 18' to pass therethrough. Jaw 11 may be stamped or cut from steel, aluminum or other suitable materials and is preferably made from 0.125" (3.18 mm) sheet steel which is painted or otherwise coated for protection and durability, as is base 17. Jaws 11, 11' have an overall length of approximately twenty-nine inches (29"-73.66 cm) for grasping tree trunks having a diameter of about twenty-six inches (26"-66.04 cm) more or less. As would be understood, for a particular use various other sizes and shapes of jaws 11, 11' may be employed. Other sizes and thicknesses of jaws 11, 11' could likewise be used, depending on the particular circumstances. Base 17 has a length of approximately twenty-eight inches (28"-71.12 cm) and a width of six inches (6"-15.24 cm) but other sizes or shapes may be used for particular ladders.

In use, ladder attachment 10 as shown in FIG. 9 is connected to ladder tree stand 50 by affixing respectively U-bolts 22, 22' to tubular ladder members 51, 51'. While U-bolts are preferred, various fasteners such as screws, bolts, clamps or brackets could also be employed. Base 17 includes a plurality of U-bolt apertures 19, 19' for convenient ladder attachment and adjustability. Once ladder attachment 10 is affixed respectively by tightening U-bolts 22, 22' by rotating winged nuts 20, 20' to respectively ladder members 51, 51' as shown in FIG. 9, with jaws 11, 11' closed, jaws 11, 11' are then manually opened by rotation in an outward direction as indicated by arrows 54. Once jaws 11, 11' have been so opened, hasps 25, 25' are then manipulated to respectively engage posts 15, 15' into respectively notches 26, 26' as partially shown in FIG. 12. Hasps 25, 25' are connected to pawls 24, 24' respectively such as by welding or the like. Hasps 25, 25' each respectively have a V-shaped terminal notch 26, 26' for securely engaging posts 15, 15' respectively. Hasps 25, 25' engage posts 15, 15' to maintain jaws 11, 11' in a fully open posture as further shown in FIG. 1.

Once ladder attachment 10 has been affixed to a selected ladder such as ladder tree stand 50 seen in FIG. 1, jaws 11, 11' are manually opened and respectively locked in place with hasps 25, 25' on posts 15, 15' as hereinbefore described. Springs 28, 28' joined respectively to pawls 24, 24' maintain respectively hasps 25, 25' to posts 15, 15' to thereby lock jaws 11, 11' in a fully open configuration. Springs 29, 30, and springs 29', 30' all of which are joined respectively to spring posts 31, 31' are utilized to bias jaws 11, 11' to the closed position as shown in FIG. 9.

Figure 2:
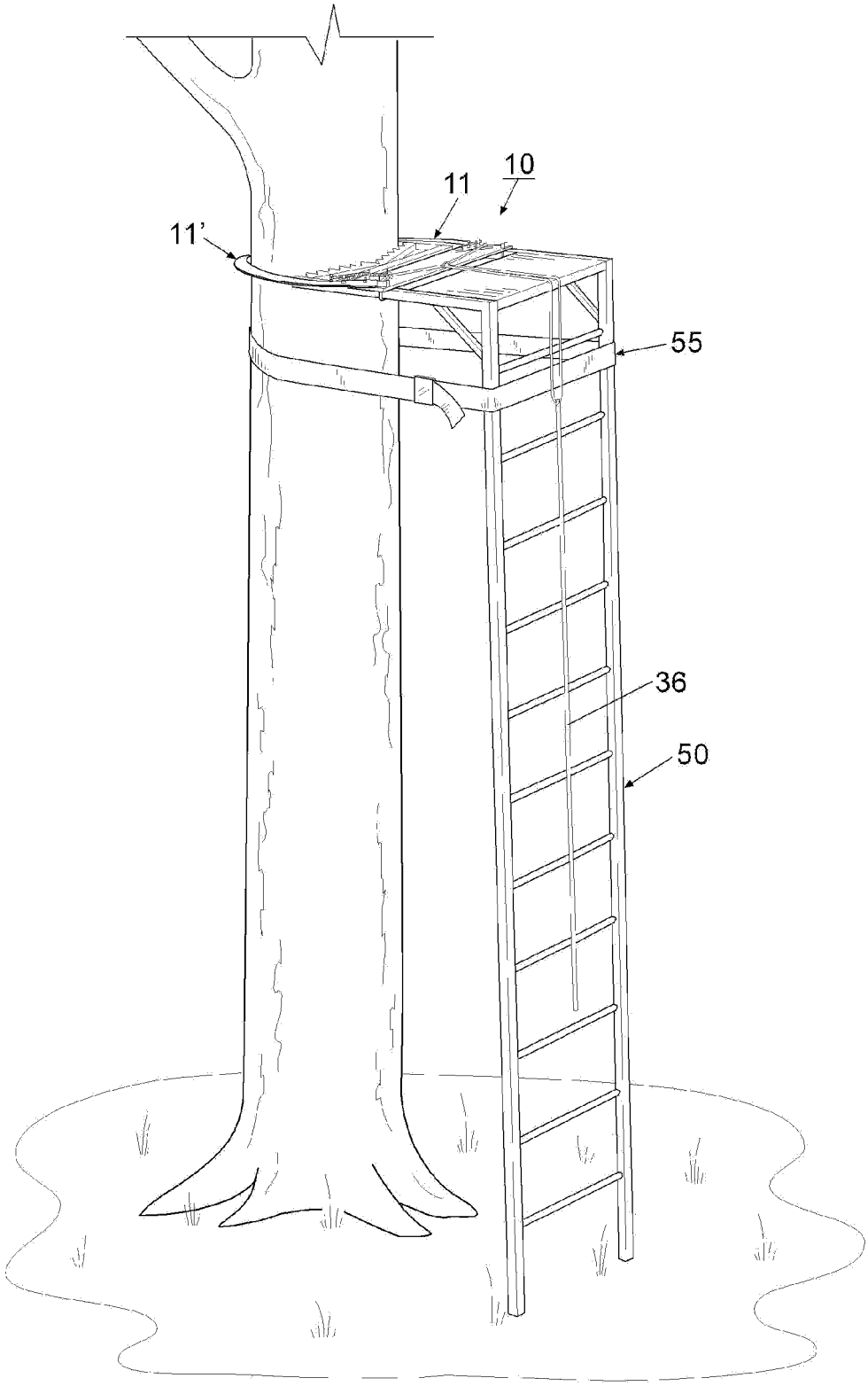
FIG. 2 schematically features the preferred ladder attachment affixed to a ladder tree stand and positioned against a tree with the jaws of the ladder attachment in a closed configuration surrounding the tree and with a conventional anchor belt securing the ladder tree stand.
Figure 10:
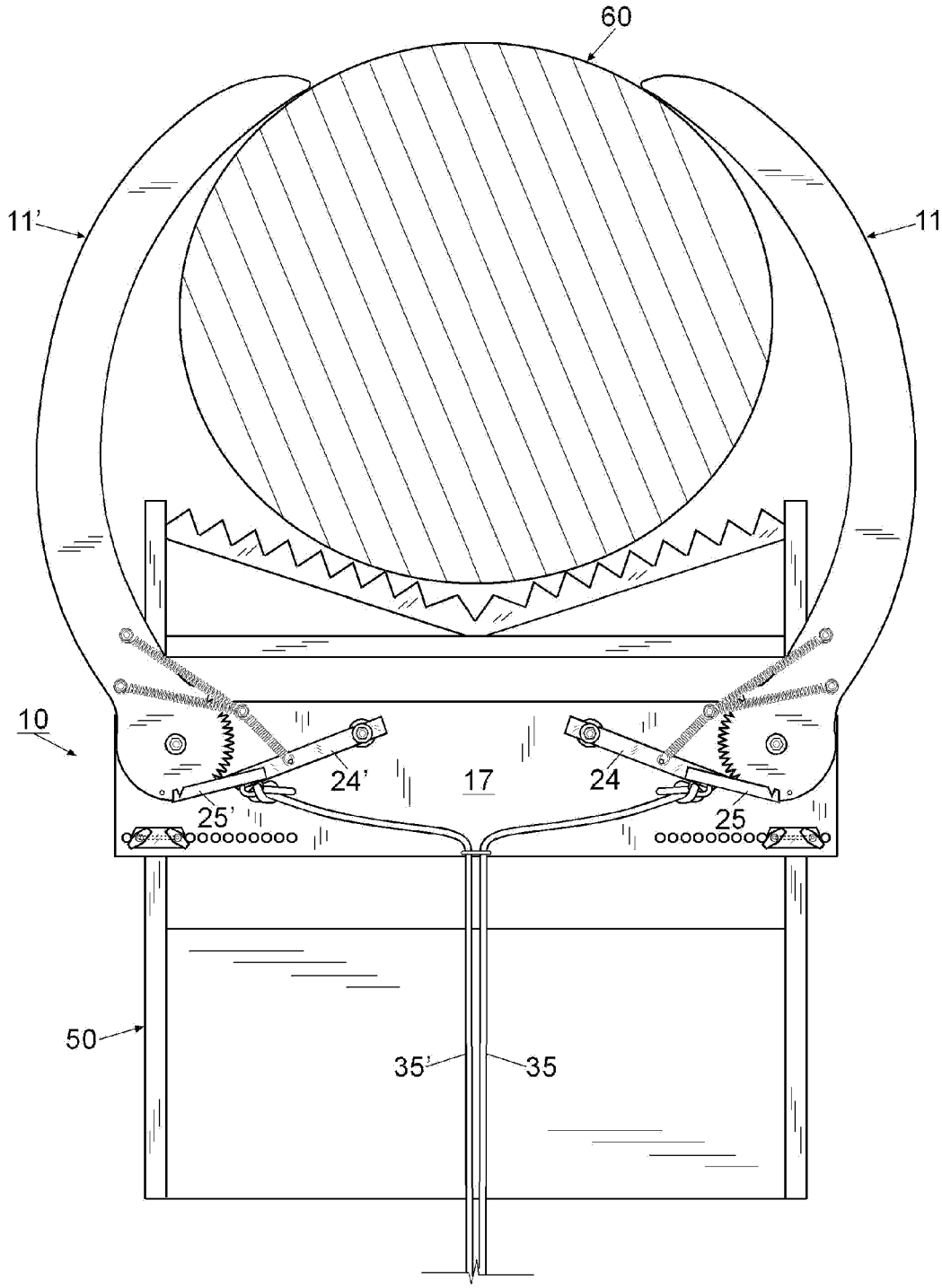
FIG. 10 shows a top view of the ladder attachment affixed to a ladder tree stand and positioned against a tree with the jaws of the ladder attachment in a closed configuration surrounding the tree.
Figure 11:
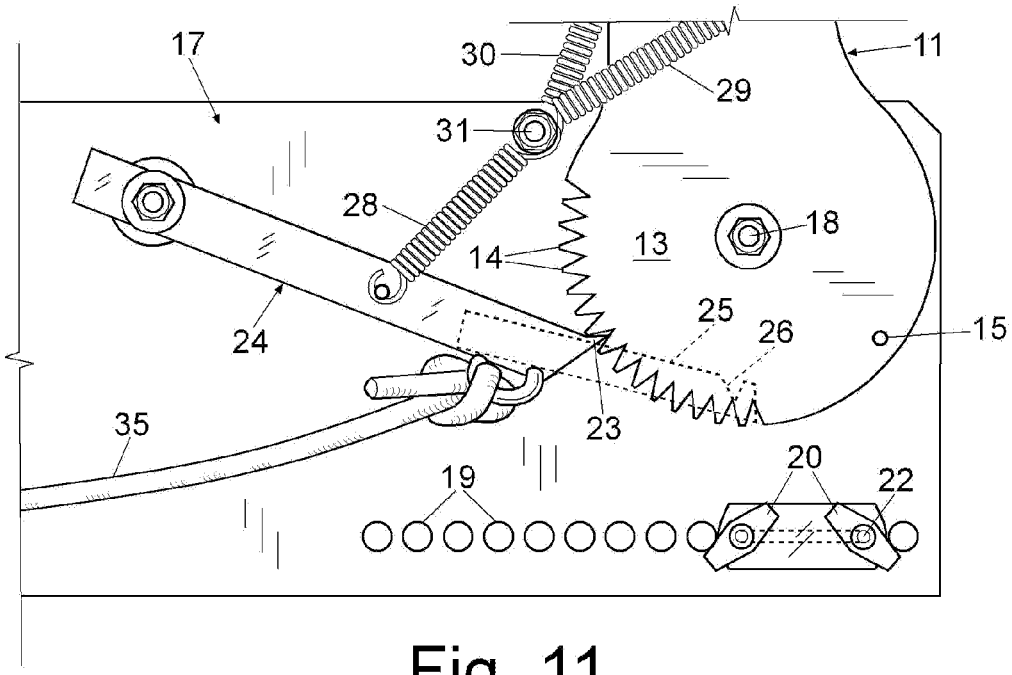
FIG. 11 depicts a partially exploded top view of the base, pawl and one of the jaws with the pawl engaged in the gear teeth.
Figure 12:
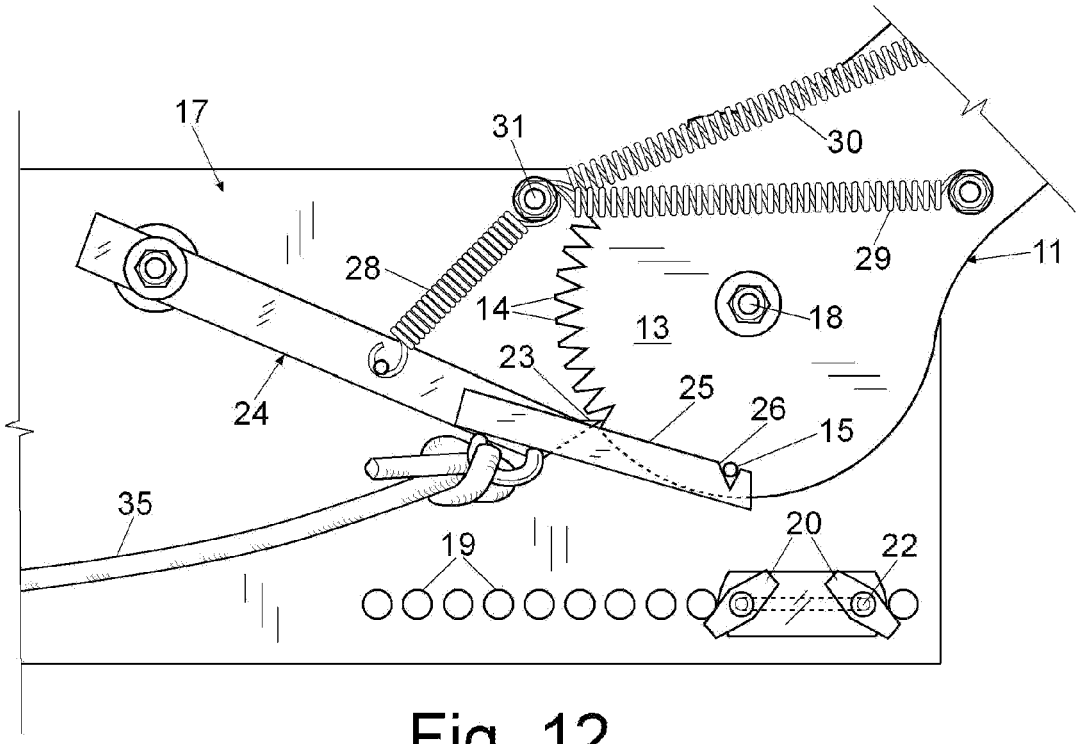
FIG. 12 demonstrates a partially exploded top view of the base, pawl and one of the jaws with the hasp engaged with the post.

With jaws 11, 11' fully open ladder tree stand 50 is then manually raised or pivoted to its upright position as shown in FIG. 2 with jaws 11, 11' surrounding tree 60, but not necessarily closed thereon. Next, while still standing on the ground the user can pull cord 36. Cord 36 as shown in FIG. 9 is joined to leaders 35, 35' which are connected respectively to pawls 24, 24'. By pulling cord 36, leaders 35, 35' respectively rotate pawls 24, 24' thus releasing hasps 25, 25' from posts 15, 15' respectively. Once hasps 25, 25' are so disengaged springs 29, 30, 29' and 30' then urge jaws 11, 11' respectively inwardly to tightly grasp tree 60 as shown in FIG. 10. As jaws 11, 11' move inwardly around tree 60, circular gears 13, 13' rotate counterclockwise and clockwise respectively to urge pawl fingers 23, 23' into engagement with gear teeth 14, 14' respectively as partially seen in FIG. 11. So engaged, jaws 11, 11' are thereby locked into a closed configuration. Once jaws 11, 11' grip tree and are locked in place, ladder tree stand 50 is then temporarily secure and safe for climbing for further securement. The hunter or user (not shown) can then climb ladder tree stand 50 without worry of the ladder tipping or falling over and can more securely affix ladder tree stand 50 to tree 60 with standard anchor belt 55 which is generally affixed to ladder tree stand 50. Anchor belt 55 is conventionally formed from nylon or other suitable materials and is sized to wrap totally around a tree such as tree 60 shown in FIG. 2 and usually includes a clasp such as a buckle or similar mechanism for adjustment and tightening purposes.

Once anchor belt 55 is so affixed, the hunter can then remove ladder attachment 10 from tree stand 50 by removing U-bolts 22, 22' by respectively loosening winged nuts 20, 20' and manually urging pawls 24, 24' respectively from gears 13, 13' thus respectively disengaging pawl fingers 23, 23' from teeth 14, 14' and allowing jaws 11, 11' to freely rotate so ladder attachment 10 can then be fully removed from tree 60. The user as desired could also pull cord 36 or leaders 35, 35' in order to disengage pawls 24, 24' respectively from gears 13, 13' to assist removal of jaws 11, 11' from tree 60. Cord 36 can also be utilized to lower ladder attachment 10 to the ground and the hunter can then descend ladder tree stand 50 which has been secured in place by anchor belt 55. Ladder attachment 10 can then be placed in his vehicle or other storage area until it is appropriate to move or disengage ladder tree stand 50 from tree 60 such as when moving to a new hunting site.

If it is decided to move ladder tree stand 50 to another tree, ladder attachment 10 is then reattached to ladder tree stand 50. Jaws 11, 11' are then closed to tightly grip tree 60 and with pawl fingers 23, 23' again engaged respectively with teeth 14, 14' anchor belt 55 can be removed from tree 60. The hunter then descends ladder tree stand 50 while ladder attachment 10 temporarily secures ladder tree stand 50 to tree 60 during his descent. Once the hunter is on the ground, cord 36 is pulled which disengages pawls 24, 24' thus releasing and allowing respectively jaws 11, 11' to pivot outwardly as ladder tree stand 50 is pivoted away from tree 60. Once jaws 11, 11' have cleared tree 60 during the ladder movement, cord 36 can be released whereby jaws 11, 11' will, by spring tension pivot to a closed position and ladder tree stand 50 is fully lowered to the ground as shown in FIG. 1. Thereafter ladder tree stand 50 with ladder attachment 10 attached can be moved for example a short distance to another tree for again fully opening jaws 11, 11' and positioning hasps 25, 25' respectively on posts 15, 15' before raising ladder tree stand 50 against the newly selected tree for attachment.

The illustrations and examples provided herein are for explanatory purposes and are not intended to limit the scope of the appended claims.

I claim:

1. A ladder attachment to maintain the top of a ladder in place, said ladder attachment comprising: a base, a first pivotable jaw, said first jaw affixed to said base, said first jaw defining a tooth, a first pawl, said first pawl attached to said base for selectively engaging said tooth, a first post, said first post attached to said first jaw, a first hasp, said first hasp affixed to said first pawl, said first hasp for engaging said first post.

2. The ladder attachment of claim 1 further comprising a spring, said spring attached to said first jaw for biasing said first jaw.

3. The ladder attachment of claim 1 further comprising a leader, said leader connected to said first hasp for releasing said first hasp from said first post.

4. The ladder attachment of claim 1 further comprising a fastener, said fastener affixed to said base for securing said base to the ladder.

5. The ladder attachment of claim 1 further comprising a second pivotable jaw, a second pawl, said second jaw defining a tooth, said second jaw and said second pawl each attached to said base.

6. The ladder attachment of claim 5 wherein said first jaw and said second jaw are arcuately shaped.

7. An attachment for a ladder comprising: a base, a pair of pivotable jaws, said pair of jaws attached to said base, and a pair of pawls, said pair of pawls rotatably affixed to said base, each of said pair of pawls for engaging different ones of said pair of jaws, a pair of hasps, each of said pair of hasps attached to different ones of said pair of pawls, a pair of posts, each of said pair of posts attached to different ones of said pair of jaws, said pair of hasps each for engaging different ones of said pair of posts.

8. The attachment of claim 7 further comprising a pair of springs, each of said pair of springs attached to different ones of said pair of jaws, said pair of springs for biasing said pair of jaws in a closed configuration.

9. The attachment of claim 8 wherein each of said pair of springs are further attached to said base.

10. The attachment of claim 7 further comprises a leader, said leader attached to each of said pair of pawls to selectively release said pair of hasps from said pair of posts.

* * * * *